US006475029B2

(12) United States Patent
Tucker et al.

(10) Patent No.: US 6,475,029 B2
(45) Date of Patent: Nov. 5, 2002

(54) SEALANT-FILLED ELECTRICAL CONNECTOR AND METHOD FOR FORMING THE SAME

(75) Inventors: Stephen Craig Tucker, Fuquay-Varina, NC (US); David Michael King, Raleigh, NC (US); Michael Ryan Stallings, Raleigh, NC (US)

(73) Assignee: Tyco Electronics Corporation, Middletown, PA (US)

( * ) Notice: Subject to any disclaimer, the term of this patent is extended or adjusted under 35 U.S.C. 154(b) by 184 days.

(21) Appl. No.: 09/840,744

(22) Filed: Apr. 23, 2001

(65) Prior Publication Data

US 2001/0014558 A1 Aug. 16, 2001

Related U.S. Application Data

(62) Division of application No. 09/343,319, filed on Jun. 30, 1999, now Pat. No. 6,224,419.

(51) Int. Cl.[7] ..... H01R 13/52
(52) U.S. Cl. ..... 439/521
(58) Field of Search ..... 439/521, 519, 439/936, 589

(56) References Cited

U.S. PATENT DOCUMENTS

| | | | | |
|---|---|---|---|---|
| 4,634,207 A | | 1/1987 | Debbaut | 439/521 |
| 5,111,497 A | | 5/1992 | Bliven et al. | 379/27 |
| 5,195,125 A | | 3/1993 | Bliven et al. | 379/29 |
| 5,246,383 A | | 9/1993 | Shimirak et al. | 439/521 |
| 5,358,430 A | | 10/1994 | Bonvallat et al. | 439/676 |
| 5,359,654 A | | 10/1994 | Jensen et al. | 379/397 |
| 5,376,019 A | | 12/1994 | Shimirak et al. | 439/521 |
| 5,404,401 A | | 4/1995 | Bliven et al. | 379/442 |
| 5,406,702 A | | 4/1995 | Shimirak et al. | 29/883 |
| 5,427,547 A | * | 6/1995 | Shimirak et al. | 439/521 |
| 5,518,415 A | * | 5/1996 | Sano | 439/204 |
| 5,557,073 A | * | 9/1996 | Truesdale | 174/151 |
| 5,562,491 A | | 10/1996 | Shimirak et al. | 439/521 |
| 5,595,504 A | * | 1/1997 | Muller | 439/521 |
| 5,598,455 A | | 1/1997 | Bliven et al. | 379/27 |
| 5,601,460 A | | 2/1997 | Shimirak et al. | 439/936 |
| 5,934,934 A | | 8/1999 | Ward | 439/521 |

FOREIGN PATENT DOCUMENTS

| | | | | |
|---|---|---|---|---|
| DE | 4427675 | * | 2/1995 | 439/521 |
| JP | 268908 | * | 9/2000 | 439/521 |

* cited by examiner

*Primary Examiner*—Neil Abrams
*Assistant Examiner*—J. F. Duverne
(74) *Attorney, Agent, or Firm*—Myers Bigel Sibley & Sajovec

(57) ABSTRACT

A sealant-filled connector assembly includes a socket having a plug cavity adapted to receive a connector plug and an environmental sealant (e.g., a gel). The connector assembly is provided with a passageway to facilitate installation of the sealant, a sealant reservoir to protect electrical leads thereof, a sealant trough to protect wire ends of an associated device connector, and/or specially configured interior cavity walls or a cavity engagement member to enhance adhesion between the sealant and the cavity. Specially configured interior cavity walls may include textured walls, bumps and/or ribs.

14 Claims, 6 Drawing Sheets

SEALANT-FILLED ELECTRICAL CONNECTOR AND METHOD FOR FORMING THE SAME

RELATED APPLICATIONS

This is a divisional of U.S. application Ser. No. 09/343,319, filed Jun. 30, 1999, now U.S. Pat. No. 6,224,419, the disclosure of which is hereby incorporated herein in its entirety.

FIELD OF THE INVENTION

The present invention relates to the field of electrical connectors, especially for telephone and data communication equipment, and, more particularly, to environmentally protected modular electrical connectors.

BACKGROUND OF THE INVENTION

Telephone line connections at subscriber locations are commonly made with the RJ-type of plug and socket connector such as an RJ-11 or RJ-45. These connectors are exemplary of electrical connections susceptible to failure from oxidation, corrosion, humidity, salt, and the like, especially in the presence of a live voltage on the conductors within the connector.

For example, it is sometimes difficult to establish and maintain an adequate environmental seal in a removable male RJ-type plug, particularly when wires lead from the male RJ-type plug. Accordingly, moisture and other environmental contaminants are allowed to enter such plugs, sometimes resulting in corrosion and/or failure of the connection of the tip and ring connections in the socket/plug combination. RJ-type sockets are likewise subject to moisture contamination and corrosion, as well as being subject to dust buildup. In hot, humid environments, such as in Florida and along the Gulf Coast of Texas, failure can occur within several months of installation. Servicing these failures is costly for the consumer or the telephone company.

Problems may also arise in connection with test ports for customer telecommunications equipment such as remote terminals at customer facilities and the like. It is often desirable to provide an RJ-type connector of the type well known to those of skill in the art, or other such connector, at an external location at a subscriber facility, such as a junction box leading to a house, or a remote terminal of the type described above. Access may be provided by installing a female RJ-type socket which is normally connected to a male RJ-type plug. The tip and ring wires (among other wires in some cases) lead from the female RJ-type socket, and connect to tip and ring connections in the male RJ-type plug, thereafter leading into the subscriber facility. When it is desired to connect test equipment to the RJ-type female socket, the plug may be removed, and another male RJ-type may be inserted into the female socket, thereby providing tip and ring connections for the test equipment. Even though the equipment may be contained in a protective housing, such arrangements are sometimes subject to much of the same moisture/corrosion degradation.

A similar problem may be experienced where RJ-type connectors are employed to connect networked computer stations for data communication. Commonly, such RJ-type connectors are used in components such as servers situated in closets. The temperatures and humidities present in the closets may vary widely and tend to degrade the connections or short circuit adjacent contacts.

Applicant has designed plug and socket type sealant-filled electrical connectors to overcome or reduce the above-described problems. See, e.g., the disclosures of U.S. Pat. Nos. 5,562,491 and 5,601,460, each to Shimirak et al.

One problem experienced with plug and socket type sealant-filled electrical connectors, including gel-filled connectors, is a tendency for the sealant material to be removed with the plug when the plug is inserted into the socket and removed. In order to improve the adhesion of the sealant to the socket as compared to the adhesion to the plug, cleaners or primer coats have been applied to the sealant contacting surfaces of the socket. However, these techniques frequently do not provide the degree of adhesion desired.

There is a need for an improved design and method for installing an environmental sealant. For example, it is often desirable to provide an environmental sealant, including a gel sealant, in connectors not originally designed to employ a sealant. It has been found that such connectors may not allow for efficient and cost-effective installation of sealant.

SUMMARY OF THE INVENTION

The present invention is generally directed to improved environmentally protected electrical connectors of the type having a socket adapted to receive a plug, and methods for forming and using the same. The inventive aspects of the present invention may be applied to RJ-type sockets, for example.

According to one aspect of the present invention, a sealant-filled connector assembly for use with a connector plug includes a socket. The socket includes a first portion, a second portion adjacent the first portion, and a plug cavity formed in the first portion and adapted to receive the plug. An electrically conductive lead has a first contact disposed in the plug cavity and a second contact positioned on the second portion. A partition wall is positioned between the plug cavity and the second portion. A connecting passageway is formed in the partition wall. The passageway provides fluid communication between the plug cavity and the second portion. An environmental sealant is disposed in the socket. The sealant is disposed in and extends continuously through the plug cavity and the passageway and into the second portion.

According to a further aspect of the present invention, a sealant-filled connector assembly for use with a connector plug includes a socket having a plug cavity formed therein adapted to receive the plug. An electrically conductive lead has a first contact disposed in the plug cavity, a second contact positioned at an opposing end of the lead, and a connecting portion extending between and joining the first and second contacts. A reservoir is located in the socket adjacent the connecting portion of the lead. An environmental sealant is disposed in the reservoir and engages at least a portion of the connecting portion.

According to a further aspect of the present invention, a sealant-filled connector assembly for use with a device connector having exposed wire ends includes a socket adapted to receive the device connector and including a trough located in the socket. The trough is positioned and configured such that, when the device connector is mounted on the socket, the wire ends of the device connector are received in the trough. An environmental sealant is disposed in the trough whereby, when the device connector is mounted on the socket, the sealant surrounds the wire ends. The socket may further include a plug cavity adapted to receive a plug, and an electrically conductive lead having a first contact disposed in the plug cavity and a second contact positioned on an opposing end of the lead.

According to a further aspect of the present invention, a connector assembly for use with a connector plug and an environmental sealant includes a socket having a plug cavity formed therein. The plug cavity is adapted to receive the plug and has an interior wall. The interior wall is textured to enhance adhesion between the sealant and the socket. An environmental sealant may be disposed in the plug cavity such that it engages the interior wall. The interior wall may have a rough surface having a rating of at least N12 per ISO 1320:1922. A raised, inwardly projecting pattern may be provided on the interior wall. The raised pattern may include a plurality of ribs.

According to a further aspect of the present invention, a connector assembly for use with a connector plug and an environmental sealant includes a socket including a plug cavity formed therein adapted to receive the plug. The plug cavity has an interior wall. An engagement member is mounted on the interior wall. The engagement member is formed of a material providing enhanced adhesion with the sealant as compared to the material of the interior wall. An environmental sealant may be disposed in the plug cavity and engage the interior wall. The engagement member may be molded. The engagement member further may be formed of an elastomeric material.

According to yet another aspect of the present invention, a method of forming a sealant-filled connector assembly for use with a connector plug includes providing a socket including a first portion, a second portion, a plug cavity formed in the first portion and adapted to receive the plug, an electrically conductive lead having a first contact disposed in the plug cavity and a second contact positioned on the second portion, a partition wall positioned between the plug cavity and the second portion, and a connecting passageway formed in the partition wall, the passageway providing fluid communication between the plug cavity and the second portion. An uncured sealant material is placed in the plug cavity such that the sealant material flows from the plug cavity, through the passageway and into the second portion. The sealant material is cured to form an environmental sealant in the socket.

According to a further aspect of the present invention, a method of connecting a device connector having exposed wire ends with a sealant-filled connector assembly includes providing a sealant-filled connector assembly comprising a socket including a trough located therein and an environmental sealant disposed in the trough. The device connector is mounted on the connector assembly such that the wire ends of the device connector are received in the trough and the sealant surrounds the wire ends.

In each of the foregoing connector assemblies and methods, the environmental sealant is preferably a gel.

The present invention is explained in greater detail with reference to the preferred embodiments in the drawings herein and the specification set forth below.

DETAILED DESCRIPTION OF THE ILLUSTRATED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 5:
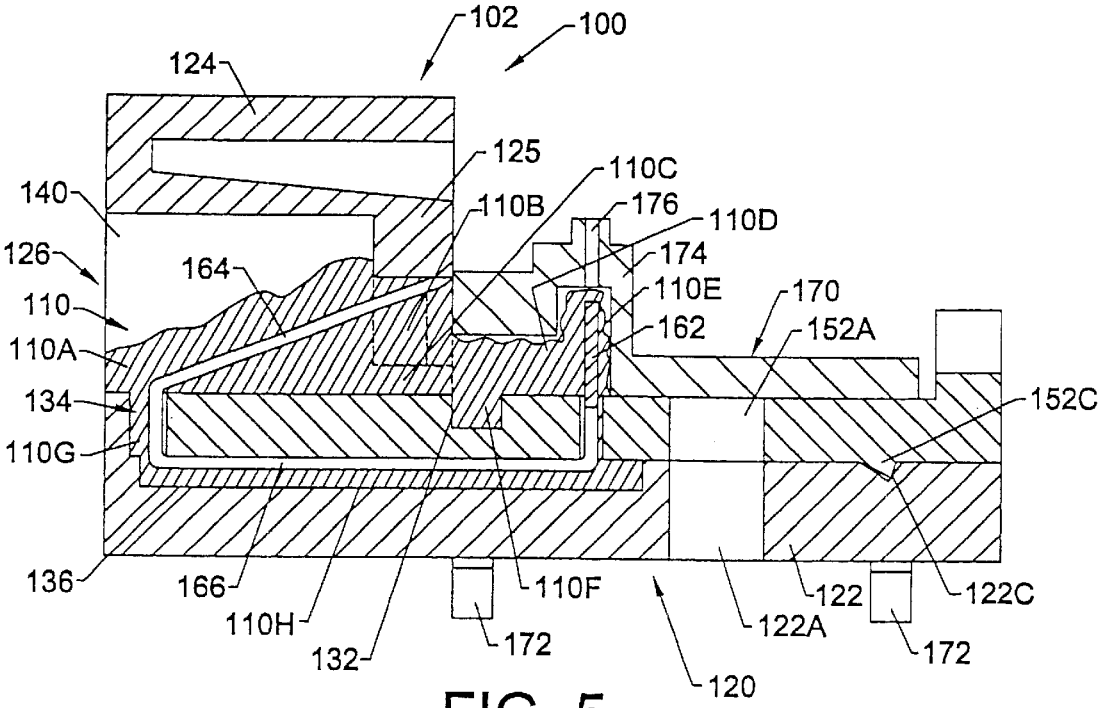
FIG. 5 is a cross-sectional view of a gel-filled connector assembly including the socket of FIG. 1 and the cap and taken along the same line as FIG. 4.
Figure 6:
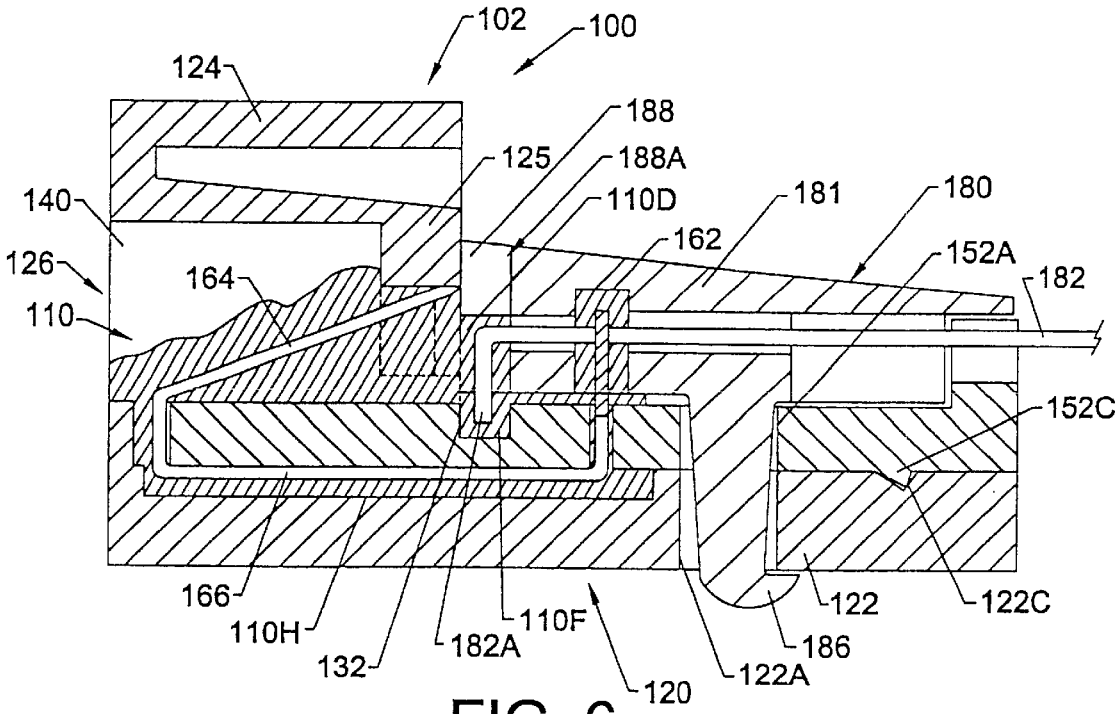
FIG. 6 is a cross-sectional view of the gel-filled connector assembly of FIG. 5 and a connector and taken along the same line as FIG. 4.

With reference to FIGS. 5 and 6, a gel-filled connector assembly according to the present invention is shown therein and generally designated 100. The gel-filled connector assembly 100 includes a socket 102. A sealant 110 is disposed within the socket 102 to protect electrically conductive components thereof from dust and moisture and other corrosives. The sealant 110 is preferably, and will hereinafter be referred to as, a gel. However, other types of sealants may be used as discussed below.

In FIG. 5, the gel-filled connector assembly 100 is shown with an associated cap 170 mounted thereon. In FIG. 6, the gel-filled connector assembly 100 is shown with an associated device connector 180 connected thereto. The connector 180 includes a load bar or wire terminating cap 181 through which four wires 182 are inserted. The load bar 181 includes partition walls 188 between the respective wires 182 adjacent the ends 182A of the wires 182. The partition walls 188 define slots 188A within which the end portions of the wires are received as shown. The load bar 181, and thereby the wires 182, are secured to the gel-filled connector assembly 100 by a connecting leg 186. It will be appreciated that more than four wires and connectors other than the connector 180 as shown and described herein may be used.

Figure 7:
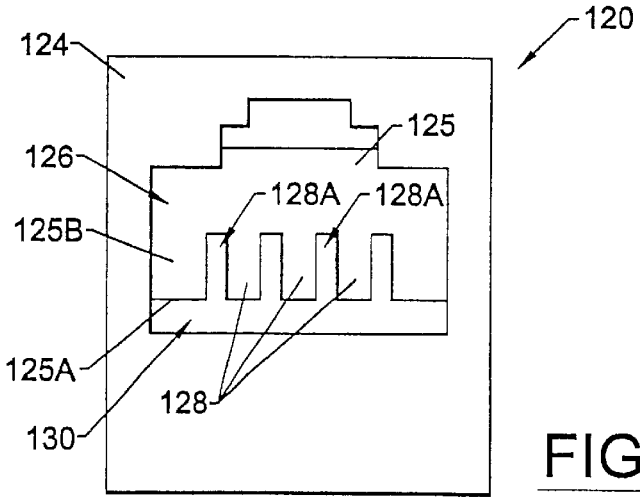
FIG. 7 is a front end view of a base member of the socket of FIG. 1.

FIGS. 1–4 show the socket 102 without the gel 110 for clarity. Similarly, FIG. 7 shows a base member 120 forming a part of the socket 102, also shown without the gel 110. The gel-filled connector assembly 100 is adapted to receive and electrically connect with a suitable male plug (not shown), for example, an RJ-type plug. RJ-type plugs are well known to those of ordinary skill in the art.

Figure 4:
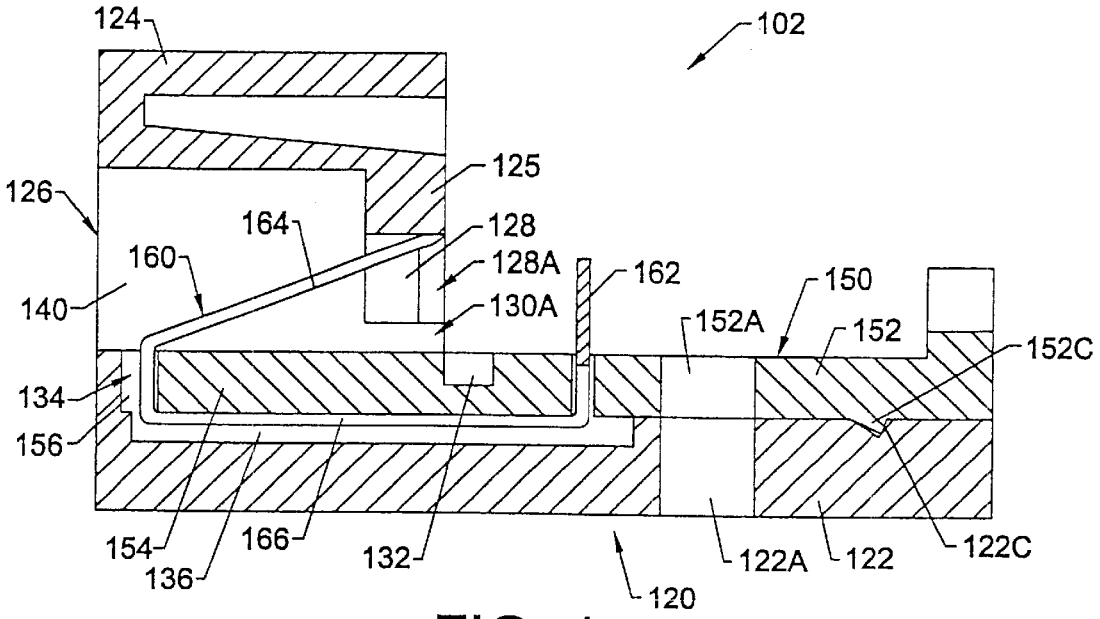
FIG. 4 is a cross-sectional view of the socket of FIG. 1 taken along the line 4—4 of FIG. 1.

Referring now to FIG. 4, the socket 102 includes the base member 120 and an insert member 150. The base member 120 has a rear portion 122 and front portion 124. The insert member 150 has a rear portion 152 and a front portion 154. The base member 120 and the insert member 150 are securely fitted together as will be better appreciated from the description that follows. It will be appreciated, however, that the inventive aspects of the present invention may be employed in sockets configured differently than described herein.

As shown, for example, in FIGS. 4 and 7, the base member 120 is preferably integrally molded from a suitable plastic such as a polycarbonate, polyphenylene oxide, or polycarbonate ABS alloy. The base member 120 includes a plug cavity 126 adapted to receive the RJ or other type plug (not shown). A rear partition wall or tine block 125 forms the back wall of the cavity 126. A series of guide walls 128 forming a part of the wall 125 form a "comb" defining a series of tine slots 128A. As described below, the lower edge 125A of the rear wall 125 is positioned to provide a passageway 130 in the base member 120. When the insert member 150 is installed in part in the base member 120, the passageway 130 defines a passageway 130A in the socket 102.

The cavity 126 has interior side wall surfaces 140. Preferably, the interior surfaces 140 are textured to increase their overall surface areas. The forwardly facing surface 125B of the rear wall 125 and/or the upper surface 157 of the insert member 150 in the cavity 126 may also be textured. The texturing may be formed by abrading the walls 140 and other surfaces or molding the walls 140 and other surfaces to make the surfaces rough. Preferably, the texturing increases the surface areas of the surfaces (as compared to smooth surfaces) by at least 10% and, more preferably, by between about 20% and 66%. The textured surfaces may be roughened by sandblasting the mold from which they are formed to provide a particulate lay to the surfaces. Preferably, the rough surfaces 125B, 140 have a rating of at least N12 per ISO 1320:1992 or a roughness average of at least 2000 micro-inches. It is also contemplated that the textured surfaces 125B, 140 may have a random or regular raised pattern, as discussed in greater detail below.

The increased surface area of the textured surface is intended to provide greater contact area between the interior surfaces 140 and the gel 110 which enhances the adhesion of the gel 110 to the socket 102. This enhanced adhesion reduces the tendency of the gel 110 to be removed from the socket 102 with a plug when the plug is inserted and removed. The enhanced adhesion also helps to reduce inward displacement of the gel when the plug is inserted, thereby helping to ensure that the tines remain fully covered when the plug is inserted. Additionally, the textured surface preferably engages the gel 110 to provide mechanical resistance to removal of the gel 110 from the socket 102.

The base member 120 further includes a cavity or reservoir 136 formed therein. The reservoir 136 extends through portions of the rear portion 122 and the front portion 124 including extending beneath the rear wall 125.

Apertures 122A and 122B (FIG. 3) are positioned in the base member 120. Also, a recess 122C is positioned in the base member 120. Preferably, the apertures 122A, 122B, 122C are formed in the base member such as by molding. The insert member 150 is preferably integrally molded of a suitable plastic such as a polycarbonate, polyphenylene oxide, or polycarbonate ABS alloy. Apertures 152A and 152B are positioned therein. A projection 152C extends from the lower surface of the insert member 150. Also, as discussed below in more detail, a cavity or trough 132 is positioned in the upper surface of the insert member 150. A series of spaced apart guide walls 156 (FIG. 1) define a series of tine slots 134 therebetween.

A plurality of side by side electrical leads 160 extend lengthwise along the insert member 150. Each lead 160 preferably includes an insulation displacement connector (hereinafter, "IDC") 162, a tine 164 and a connecting portion 166. Preferably, each lead 160 is formed of a continuous and integral strip of electrically conductive metal. As best seen in FIG. 4, for each lead 160, the IDC 162 projects above the upper surface of and extends through the thickness of the insert member 150, the connecting portion 166 extends along the bottom surface of the insert member 150, and the tine 164 is positioned in a respective one of the slots 128 and a respective one of the slots 134. Preferably, the tines are spring loaded, i.e., biased upwardly against the rear wall 125. It will be appreciated that more leads 160 may be provided. In particular, there may be provided a second row of IDCs 162 staggered with the first row of IDCs 162 and allowing for an increased number of tines 164 (e.g., eight tines, as may be required in a data or telephone jack). For clarity, only a single row of IDCs 162 is shown and described.

The insert member 150 is mounted in the base member 120 by sliding the front end 154 through the passageway 130. As the insert member 150 is inserted, the tines 164 are received in, guided by and retained in spaced apart relation by the walls 128. When the insert member 150 is fully inserted, the projection 152C interlocks with the recess 122C. Optionally, the members 120 and 150 may be bonded, welded, mechanically fastened or otherwise further joined. Notably, the upper surface of the insert member 150 and the lower edge of the rear wall 125 define a passageway 130A in the passageway 130.

Once the socket 102 has been assembled as described above, the gel material 110 may be installed. It will be appreciated that methods of installing the gel other than as described hereinbelow may be employed.

Figure 1:
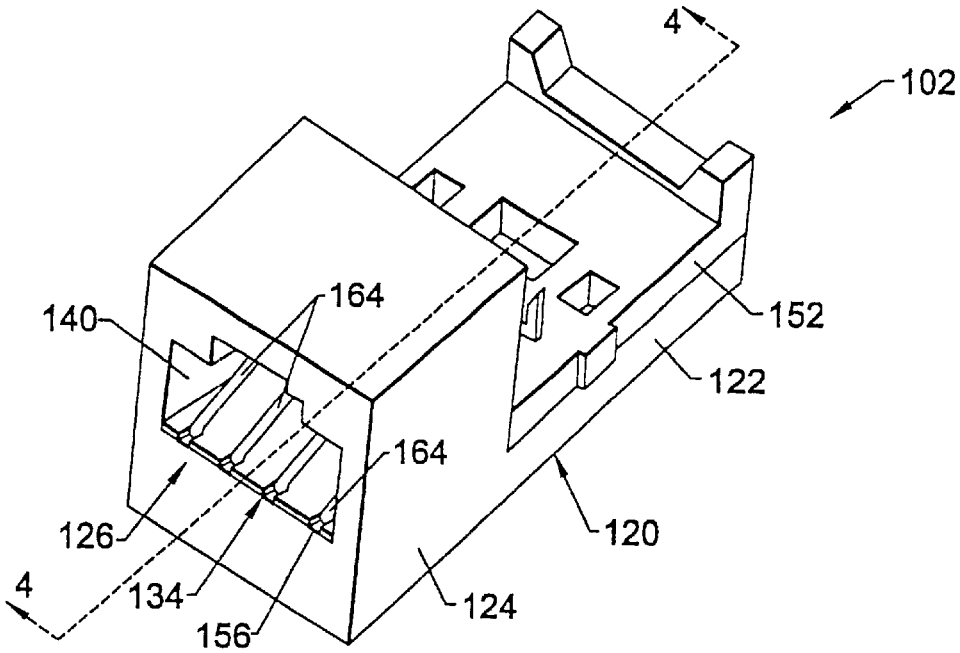
FIG. 1 is a front perspective view of a socket according to the present invention.
Figure 2:
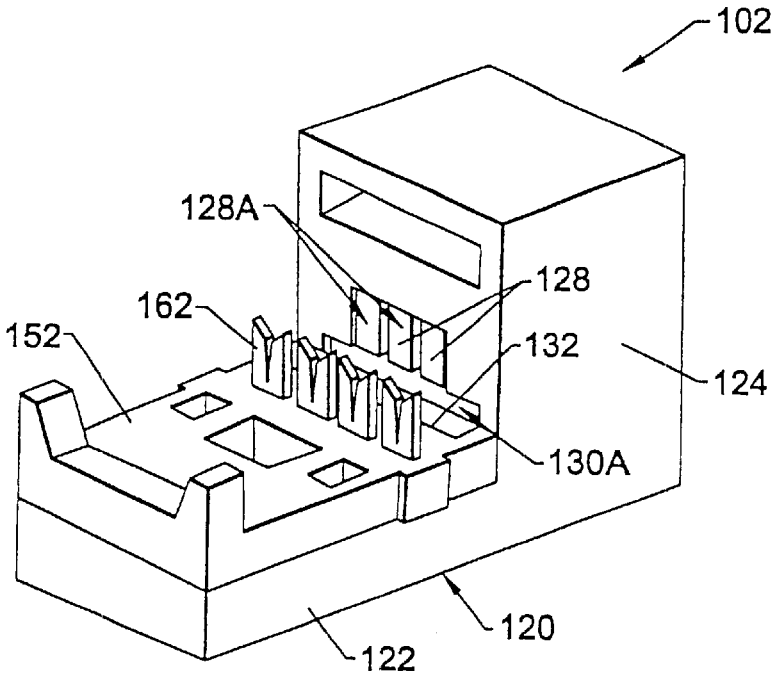
FIG. 2 is a rear perspective view of the socket of FIG. 1.
Figure 3:
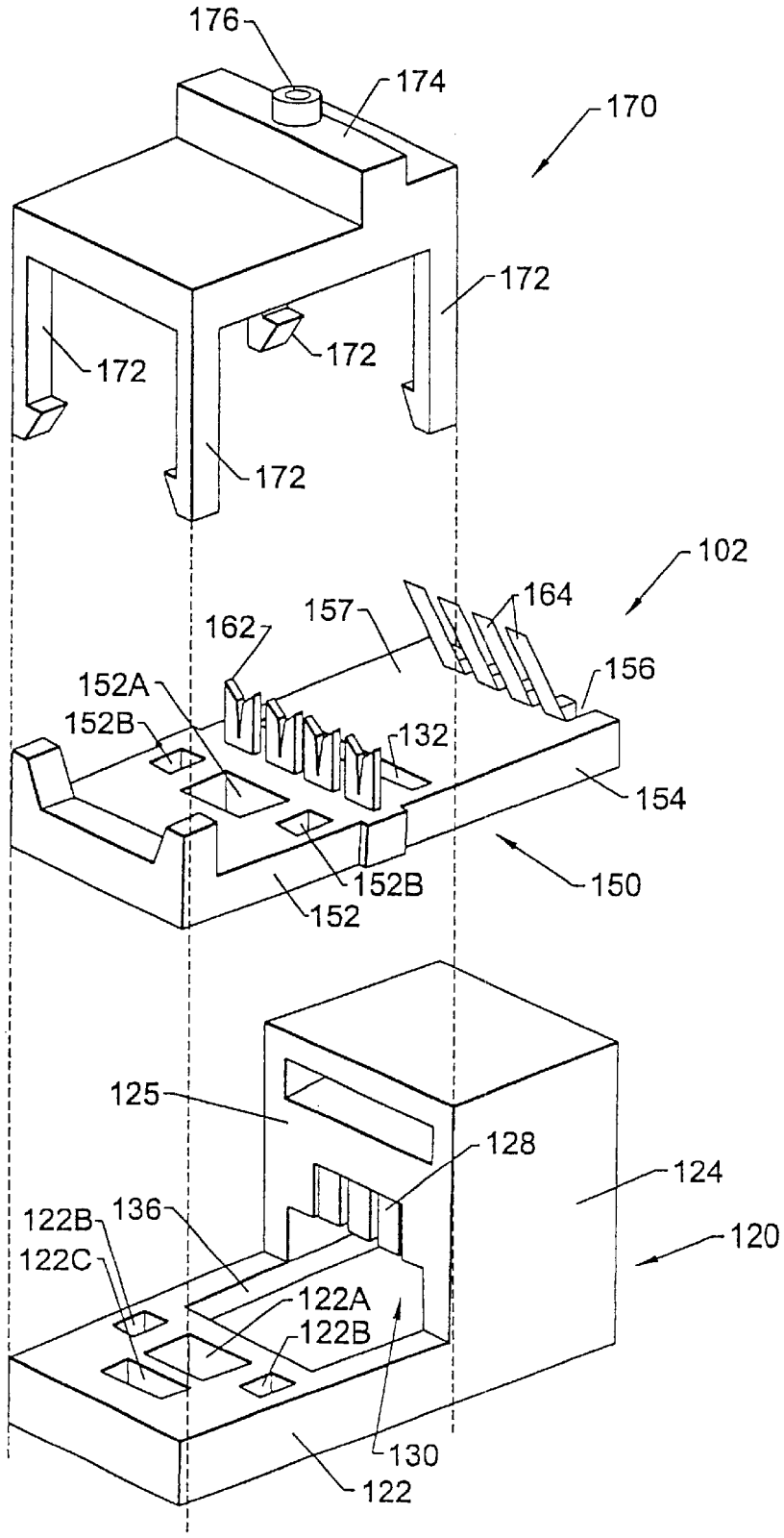
FIG. 3 is an exploded view of the socket of FIG. 1 and a cap.

With reference to FIGS. 3 and 5, prior to gel installation, the cap 170 is mounted on the socket 102 such that the legs 172 snap fit over the socket 102 and a prescribed portion 174 of the cap receives the row of IDCs 162. The socket 102 is placed such that the front portion 124 is oriented vertically over the rear portion 122. An uncured gel material is then poured into the socket 102 through the cavity 126. The socket 102 is configured such that each of the various cavities 126, 132, 136 defined by the base member 120 and the insert member 150 are filled and the exposed portions of the leads 160 are covered. The uncured gel material flows through and into the slots 128A and the passageway 130A to fill the trough 132 and to cover the IDCs 162 as shown. Notably, the passageway 130A provides a substantial passageway for flow of the gel material allowing for fast and consistent flow of the uncured gel material from the cavity 126 to the rear portion of the socket 102. Flow of the gel material into these areas is facilitated by an air vent 176 formed in the cap 170. Additionally, gel material flows through the slots 134 to fill the reservoir 136.

Once the cavities 126, 132, 136 and the passageway 130A have been filled, the socket 102 is preferably tilted such that the tines 164 are oriented substantially parallel with the horizontal plane. The gel material is then cured by suitable means to form the gel 110. In the preferred embodiment, as shown, the gel covers the tines 164 while leaving an unfilled portion of the cavity 126 to accept a plug.

The environmental sealant 110 is preferably a hydrophobic dielectric designed to exclude moisture and insulate the wires and contacts. Gels are preferred, with the most preferred being silicone gels. The preferred gels have a cohesiveness greater than their tack (adhesion to other surfaces), so that when the plug is removed from the socket 126, the gel 110 will release the plug rather than separating from the main body of gel within the socket. The gel requires a sufficient adhesion, however, so that it will form an acceptable seal around the contacts, wires, and other portions of the apparatus in need of environmental protection.

The sealant should have a hardness sufficient to provide lasting protection against environmental contaminants. On the other hand, the sealant should be soft enough to be displaced by the plug and conform to the shape of the socket assembly and adequately seal it while allowing an acceptable electrical connection between the socket and the plug. The gel's hardness may also impact a customer preference: an audible "click" when the RJ-type plug is fully inserted and latches into the RJ-type socket. If the sealant is too stiff, this click may be muted.

A wide variety of sealants are available for this use, including, for example, elastic hot melt materials, greases, and flexible epoxies. Preferably, the sealant is a dielectric gel such as an oil or plasticizer extended aliphatic urethane gels, urea gels, silicone gels, and thermoplastic gels like styrene-ethylene-butylene-styrene or styrene-ethylene-propylene-styrene, or other soft gels having the required properties below whether or not oil or plasticizer extended, including those disclosed in U.S. Pat. Nos. 4,634,207; 4,600,261; 4,643,924; 4,865,905; 4,662,692; 4,595,635; 4,680,233; 4,716,183; 4,718,678; 4,777,063; and 4,942,270, which are completely incorporated herein by reference for all purposes.

Preferred gels used in conjunction with the present invention include those having a cone penetration value from about 50 to about $350\times10^{-1}$ mm, more preferably about 100 to about $300\times10^{-1}$ mm, and most preferably about 100 to about $250\times10^{-1}$ nm. Preferred gels also have an ultimate elongation of at least about 100%, more preferably at least about 500% to 1000%, and most preferably greater than 1400%. Alternatively from cone penetration, another measurement for hardness is Voland hardness. The Voland hardness is generally measured on a Voland texture analyzer apparatus. Voland hardnesses from about 10 grams to at least about 50 grams are acceptable for the gel, with preferred gels having Voland hardnesses from about 20 to about 40 grams. The preferred environmental sealant is a silicone gel having a Voland hardness of about 29±6 grams, a stress relaxation of about 28±10%, and a tack of about 17±5 grams.

The cavities of the RJ-type plug (not shown) are also preferably substantially completely filled with the gel 110.

Following the curing step, the gel 110 is distributed through the socket 102 as shown in FIG. 5, and with reference to FIG. 4. A portion 10A of the gel fills a substantial portion of the cavity 126 and covers the tines 164. A portion 110B of the gel fills the slots 128A and a portion 110C of the gel fills the passageway 130A. A portion 110D of the gel fills the space between the rear wall 125 and the IDCs 162. A portion 110E of the gel surrounds and extends between the IDCs 162. A portion 110F of the gel fills the trough 132. A portion 110G of the gel fills the slots 134. A portion 110H of the gel fills the reservoir 136.

When the connector 180 is mounted on the gel-filled connector assembly 100 as shown in FIG. 6, each IDC 162 displaces the insulation of a respective one of the wires 182 and makes electrical contact with the wire conductor. It will be appreciated that when the connector 180 is engaged with the gel-filled connector assembly 100 (and also when the RJ plug is inserted (not shown)), the IDCs 162, the tines 164, and the connecting portions 166 are fully encapsulated or "sealed" in the socket 102 and the gel 110 such that they are protected from moisture or contaminates from the environment. Notably, the gel portion 110H in the reservoir 136 covers the connecting portions 166. In this way, the gel portion 110H also serves to electrically isolate the respective connecting portions 166 from one another. Such electrical isolation is of particular benefit when the devices 100 are used in humid environments which might otherwise cause short circuiting between adjacent ones of the connecting portions 166. The gel portion 110H also serves to protect the connecting portions 166 from corrosion and the like. The wire ends 182A are received in the gel portion 110F in the trough 132. Similarly, the gel portion 110F serves to electrically isolate the wire ends 182A from one another and to protect the wire ends from contamination. Also, part of the gel portion 110D fills some or all of the slots 188A of the load bar 181.

As shown in FIG. 6, the apertures 122A, 152A receive the connecting leg 186 of the connector 180. The apertures 122B, 152B (FIG. 3) receive locating projections (not shown) of the connector 180. It will be appreciated that other means for attaching the connector 180 to the socket 102 may be provided.

Figure 8:
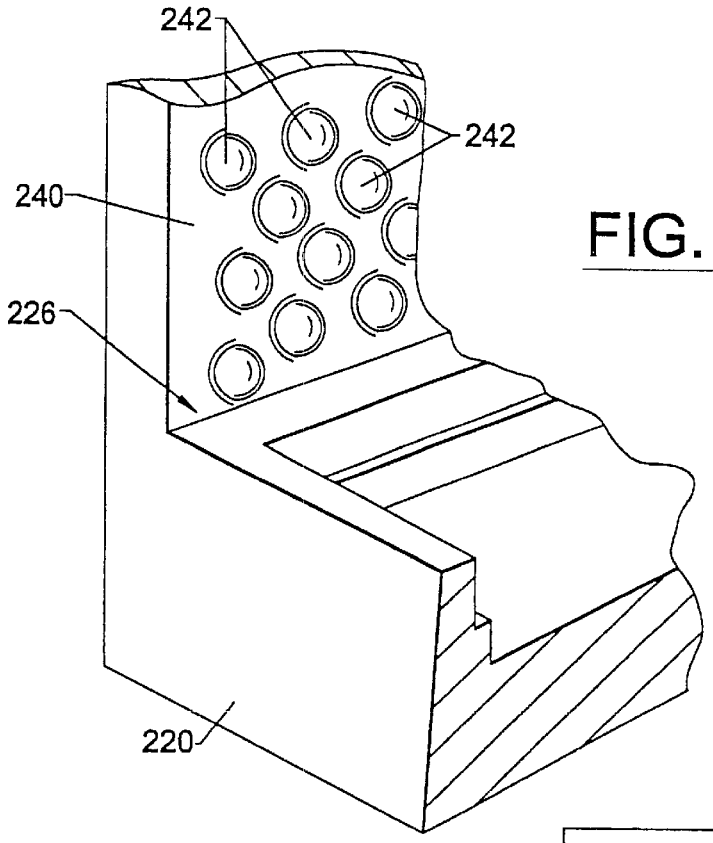
FIG. 8 is a fragmentary, enlarged view of a base member according to a further embodiment of the invention.

As discussed above, it is particularly contemplated that the textured surfaces of the plug cavity may have a raised pattern. A preferred raised pattern is illustrated in FIG. 8 which shows an enlarged, fragmentary view of a side wall 240 of an alternative base member 220 otherwise corresponding to the base member 120 and which may be used in place thereof. The side wall 240 corresponds to the side wall 140 except that the side wall 240 includes a plurality of raised protrusions or bumps 242 extending into the plug cavity 226. The bumps 242 may be arranged in a random, regular or semi-regular pattern. The bumps 242 are preferably molded into the base member 220, and a reverse pattern may be machined or electric discharge machined into the mold. Bumps may also be formed on the forwardly facing surface of the rear wall (not shown) and/or the upper surface of the portion of the insert member (not shown) in the cavity 226. The bumps 242 serve to increase the surface area for engagement with the gel (not shown) as well as to mechanically retain the gel. Preferably, the bumps are substantially half-spheres having a radius of between about 0.005 inch and 0.030 inch.

In the embodiment of FIG. 8, the bumps 242 are spaced apart. According to a further embodiment (not shown), the bumps are intertangential such that the bumps are arranged as densely as feasible. The bumps are otherwise formed as described with regard to the base member 220.

Figure 9:
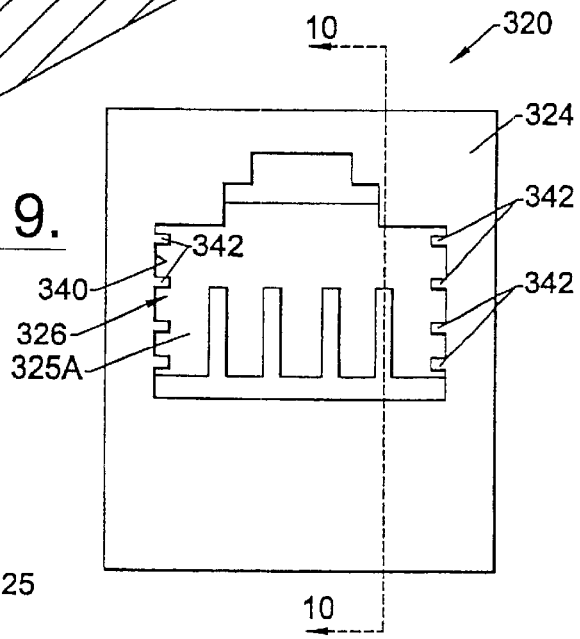
FIG. 9 is a front end view of a base member according to a further embodiment of the present invention.
Figure 10:
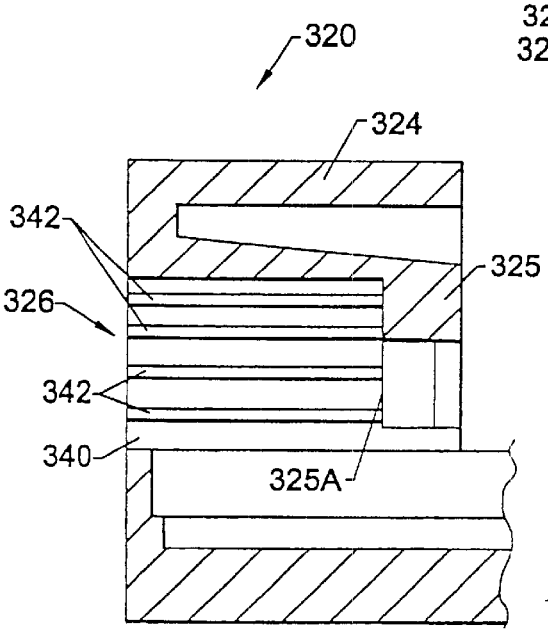
FIG. 10 is a fragmentary, cross-sectional view of the base member of FIG. 9 taken along the line 10—10 of FIG. 9.

With reference to FIGS. 9 and 10, a base member 320 according to a further embodiment is shown therein. The base member 320 may be used in place of the base member 120 as described above. Except as discussed below, the base member 320 is preferably formed in the same configuration, in the same manner, and from the same materials as the base member 120. A plug cavity 326 is formed in the front portion 324 of the base member 320. The interior surfaces 340 of the plug cavity 326 of the base member 320 include a plurality of integrally molded ribs 342 extending inwardly therefrom. The ribs 342 serve to increase the surface area for engagement with the gel (not shown) in similar manner to the raised pattern described above with regard to the base member 220. Ribs (not shown) may also be formed on the forwardly facing surface 325A of the rear wall 325 and/or the exposed surface of the insert member (not shown) in the cavity 326. The ribs may be disposed at angles other than as shown in the illustrated embodiment.

Raised patterns of configurations other than those described above may be employed. For example, the raised patterns may be pyramids.

Figure 11:
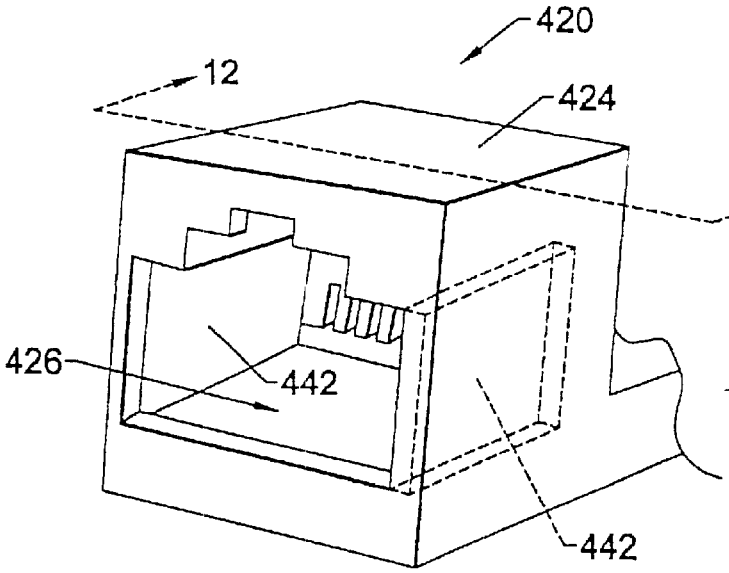
FIG. 11 is a fragmentary, perspective view of a base member according to a further embodiment.
Figure 12:
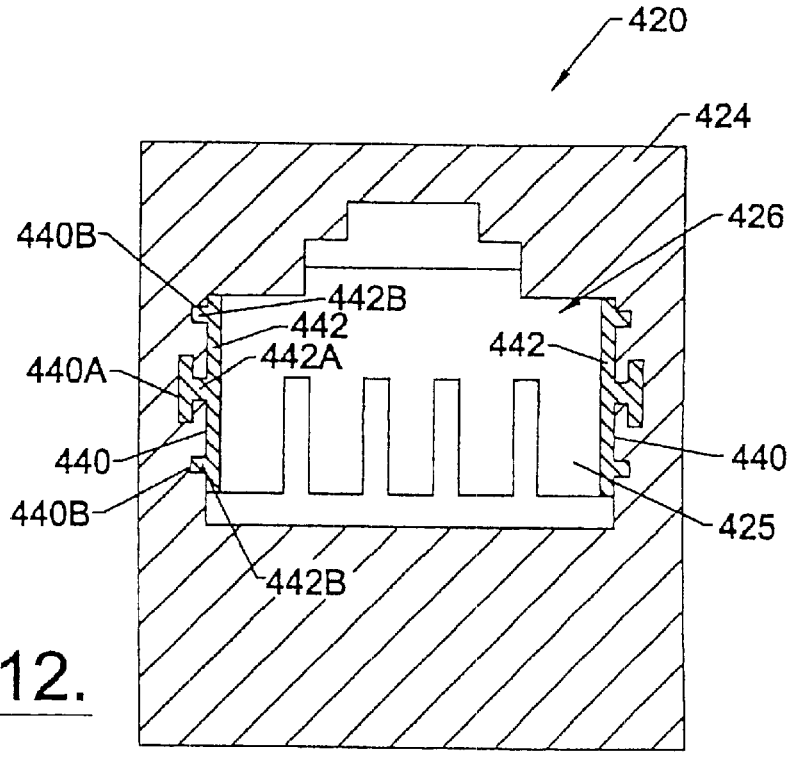
FIG. 12 is a cross-sectional view of the base member of FIG. 11 taken along the line 12—12 of FIG. 11.

With reference to FIGS. 11 and 12, a base member 420 according to a further embodiment of the present invention is shown therein. The base member 420 may be used in place of the base member 120 as described above. A plug cavity 426 is formed in the front portion 424 of the base member 420. The interior surfaces 440 of the cavity 426 are covered by molded inserts 442. The molded inserts 442 are formed of a material exhibiting greater adhesion with the gel (not shown) than the material from which the base member 420 is formed. Preferably, the mold inserts 442 are formed from elastomeric material. More preferably, the mold inserts 442 are formed from silicone rubber, and, more preferably, from addition-cured silicone rubber. The mold inserts 442 are secured to the walls of the base member 420 in the illustrated embodiment by respective T-shaped projections 442A and nibs 442B which are received in complementary shaped slots 440A and 440B, respectively. Alternative means for securing the molded inserts 442 may be used as an alternative to or in addition to the elements 442A, 442B, 440A, and 440B. For example, the molded inserts 442 may be bonded or adhered to the interior surfaces 440. Preferably, the slots 440A, 440B are formed during the molding of the base portion 420 and the molded inserts 442 are formed and mounted in the cavity 426 by injection molding. The inserts 442 enhance the mechanical adhesion between the gel and the base member and may also form a chemical bond with the gel. The inserts 442 may also include integrally molded bumps, ribs or other raised patterns or other texturing as described above to engage the gel in the cavity 426.

The foregoing is illustrative of the present invention and is not to be construed as limiting thereof Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A connector assembly for use with a connector plug and an environmental sealant, said connector assembly comprising:

a socket including a plug cavity formed therein adapted to receive the plug, said plug cavity having first and second opposed interior side walls and first and second raised, inwardly projecting patterns on said first and second interior side walls, respectively, wherein said first and second raised patterns are adapted to enhance adhesion between the sealant and said socket.

2. The assembly of claim 1 including an environmental sealant disposed in said plug cavity and engaging each of said first and second interior side walls.

3. The assembly of claim 2 wherein said sealant is a gel.

4. The assembly of claim 1 wherein said first and second raised patterns are integrally molded with said first and second interior side walls.

5. The assembly of claim 1 wherein said first and second raised patterns each include a plurality of raised bumps.

6. The assembly of claim 1 wherein said first and second raised patterns each include a plurality of ribs.

7. A connector assembly for use with a connector plug and an environmental sealant, said connector assembly comprising a socket including:

a plug cavity formed therein adapted to receive the plug, said plug cavity having an interior wall; and an engagement member separately formed from and mounted on said interior wall, said engagement member formed of a material providing enhanced adhesion with the sealant as compared to the material of said interior wall.

8. The assembly of claim 7 including an environmental sealant disposed in said plug cavity and engaging said interior wall.

9. The assembly of claim 8 wherein said sealant is a gel.

10. The assembly of claim 7 wherein said engagement member is formed of an elastomeric material.

11. The assembly of claim 7 wherein said engagement member is bonded to said interior wall.

12. The assembly of claim 7 wherein said engagement member is mechanically attached to said interior wall.

13. A connector assembly for use with a connector plug and an environmental sealant, said connector assembly comprising:

a socket including:

a plug cavity formed therein adapted to receive the plug along an insertion direction, said plug cavity having an interior wall and a plug cavity depth along said insertion direction; and a plurality of inwardly projecting, raised bumps on said interior wall, wherein each of said raised bumps extends transversely to said insertion direction and has a depth extent along said insertion direction that is less than said plug cavity depth.

14. The assembly of claim 13 wherein said depth extent of each of said raised bumps is between about 0.005 inch and 0.030 inch.

* * * * *